United States Patent [19]

Bonalumi

[11] 3,987,517

[45] Oct. 26, 1976

[54] PNEUMATIC DUST COLLECTING SYSTEM FOR FIBER PROCESSING MACHINE

[76] Inventor: Ettore Bonalumi, Via Lega Lombarda 7, Bergamo, Italy

[22] Filed: June 26, 1975

[21] Appl. No.: 590,703

Related U.S. Application Data

[63] Continuation-in-part of Ser. No. 263,594, June 16, 1972, abandoned.

[30] Foreign Application Priority Data

June 17, 1971 Italy ..... 25968/71

[52] U.S. Cl. ..... 19/107; 55/319; 55/419; 55/467

[51] Int. Cl.[2] ..... D01G 15/76

[58] Field of Search ..... 19/107; 55/419, 319, 55/467

[56] References Cited

UNITED STATES PATENTS

| | | | |
|---|---|---|---|
| 3,150,415 | 9/1964 | Reiterer | 19/107 |
| 3,486,309 | 12/1969 | Wild | 19/107 |

*Primary Examiner*—Bernard Nozick
*Attorney, Agent, or Firm*—Haseltine, Lake & Waters

[57] ABSTRACT

A pneumatic dust collecting system for a fiber processing machine which includes a tank having a chamber therein within which separate streams of dust and reusable fibrous material are received and collected. The tank contains an air expansion compartment adjacent the receiving and collecting chamber and shares a common wall which functions as a filter. A blower assembly is positioned within the tank and is adapted to apply suction to the air expansion compartment so as to draw air from the chamber via the compartment and to force a stream of pressurized air from the tank to an air pressure stabilizing chamber located adjacent one end of the fiber processing machine. An air manifold having a plurality of spaced discharge nozzles is connected to the air pressure stabilizing chamber and is adapted to discharge a blanket of air beneath the machine. A waste material receiving receptacle is positioned adjacent the other end of the fiber processing machine and has an inlet adapted to receive a stream of air, dust and some fibrous material blown into same by the plurality of nozzles. The thus received stream of air, dust and fibrous particles is sucked into the receiving and collecting chamber of the tank. A separate conduit system draws reusable fibers from the fiber processing machine into a separate section of the receiving and collecting chamber of the tank. The various elements constitute an effectively closed recirculating system.

8 Claims, 6 Drawing Figures

10
12
14
16
18
20
22
38
40
42
44
46
50
52
54
56
60
62
66
67
68
70
72
74
76
78
80
82
84
86

PNEUMATIC DUST COLLECTING SYSTEM FOR FIBER PROCESSING MACHINE

The present application is a continuation-in-part of prior copending patent application Ser. No. 263,594 filed June 16, 1972 now abandoned and claims the date thereof for all commonly disclosed subject matter.

BACKGROUND OF THE INVENTION

The present invention relates to pneumatic dust collecting systems for fiber processing machines and more particularly to such a system for removing dust and fibrous material from fiber carding machines.

As is well known, during the operation of fiber carding machines substantial quantities of dust are generated which include short lengths of fiber, dust and extraneous material. The dust thus generated pervades the area in and around the carding machine thereby creating a health hazard for the machine operators, a fire hazard, and results in the loss of a certain amount of fibrous material which, if recovered can be recycled to the machine for reuse in the carding steps.

Apparatus has been known heretofore for removing the dust material emanating from the various portions of the carding machine such as from under the lickerin, from the main card cylinder or swift, from flats and from within the web area of the carding machine. However such prior apparatus utilize a considerable amount of power, are expensive and do not provide for satisfactory separation of the reusable fibrous material from the waste portion of the collected dust.

SUMMARY OF THE INVENTION

One object of the present invention is the provision of a dust collecting system for a fiber processing machine which is not an inseparable portion of the fiber processing machine but which can readily be operatively connected thereto.

Another object of the invention is the provision of a dust collecting system adaptable for operative connection with individual fiber carding machines thereby obviating the need for a cumbersome central waste removal system.

A further object of the invention is the provision of a pneumatic dust collecting system for a fiber processing machine in which the reusable fibrous material is collected separately from the waste material.

Still another object of the invention is the provision of a pneumatic dust collecting system for a fiber processing machine which is operative with minimal power consumption.

Other objects and advantages of the invention will become readily apparent to persons skilled in the art from the ensuing description of the invention.

In accordance with the present invention there is provided a pneumatic dust collecting system for a fiber processing machine comprising a plurality of beams adapted to rest on a floor and support a fiber processing machine above the floor, a tank for the collection of dust and fibrous material, a chamber within said tank adapted to receive and collect separate streams of said dust and fibrous material, at least one wall of said chamber being adapted to function as a filter for said dust and fibrous material, an air expansion compartment within said tank adjacent said receiving and collecting chamber, at least said filter wall of said chamber being common to said chamber and compartment, a blower assembly positioned within said tank adapted to apply suction to said compartment and to draw air therefrom, an air pressure stabilizing chamber, means for connecting said stabilizing chamber with said tank so as to convey a stream of pressurized air thereto from said tank, an air manifold having a plurality of linearly spaced discharge nozzles connected to said stabilizing chamber and positioned beneath one end of said machine, said nozzles being adapted to discharge a blanket of air beneath said fiber processing machine from a first location adjacent the said one end of said machine to a second location adjacent the opposite end of said machine, a waste material receiving receptacle being positioned at said second location, said discharge nozzles and receptacle extending transversely of said machine and said receptacle including a transversely extending inlet, said receptacle being in communication with said receiving and collecting chamber for supplying a stream of air and dust thereto, conduit means being provided for connecting said receiving and collecting chamber with at least one location of said machine where waste fibrous material tends to accumulate, and means for effecting operation of said blower assembly whereby waste material on the floor beneath said machine is acted upon by air streams discharged from said nozzles and suction forces emanating from the inlet of said receptacle and thereby is advanced in a unidirectional manner to said receptacle for conveyance to said receiving and collecting chamber.

BRIEF DESCRIPTION OF THE DRAWINGS

In order that the invention may be fully understood it will now be described, by way of example, with reference to the accompaying drawings in which.

DETAILED DESCRIPTION OF THE INVENTION

Figures 1, 2, 3, 4:
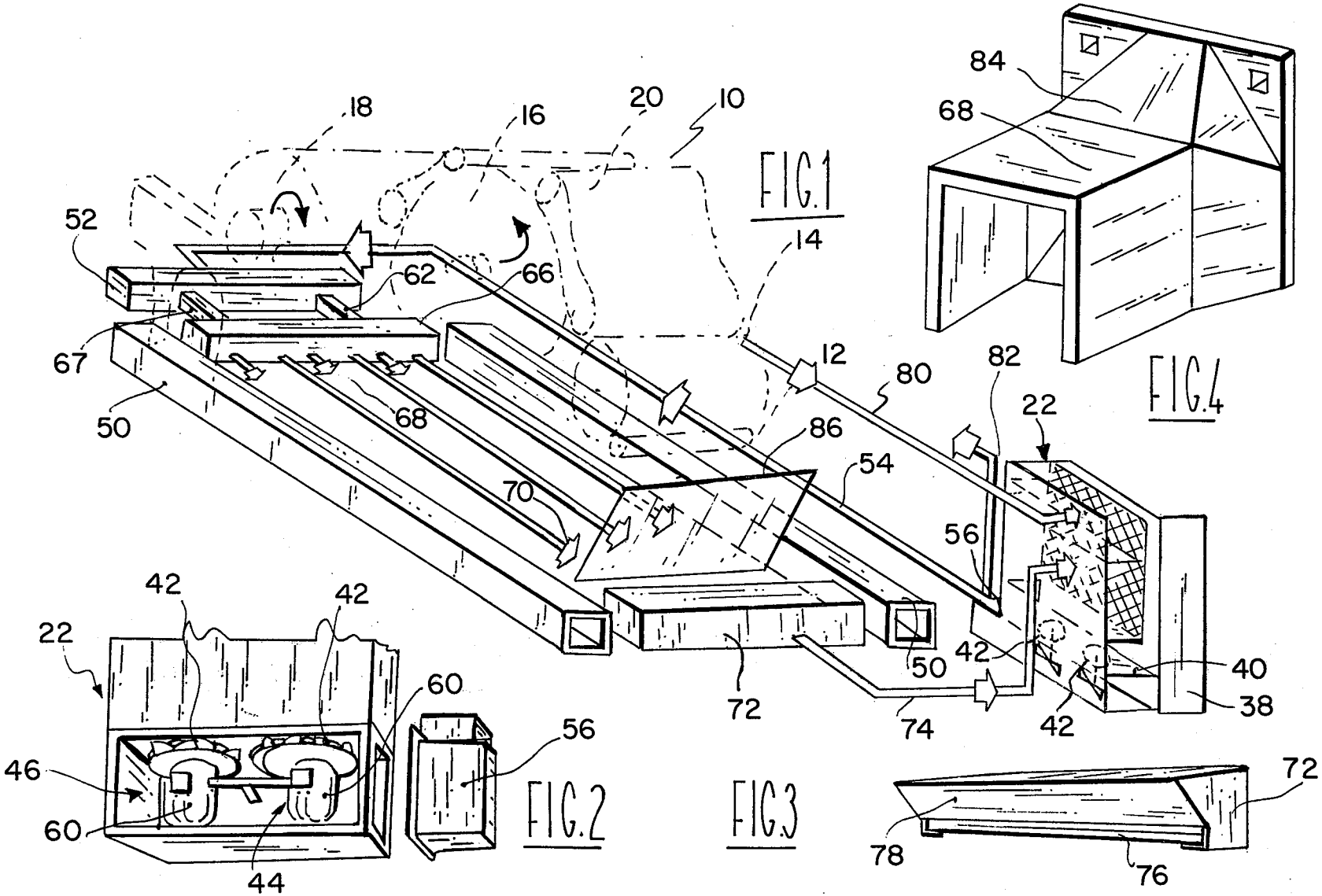
FIG. 1 is a schematic illustration of the dust collecting system of the invention with a fiber processing machine shown in phantom.
FIG. 2 is a partial side view of the tank element of the system of the invention with the cover for the blower assembly section removed therefrom.
FIG. 3 is a perspective view of the waste material receiving receptacle employed in the system.
FIG. 4 is a perspective view of a nozzle construction.

Referring to the drawings particularly FIG. 1 thereof, there is shown a dust collecting system as applied to a fiber carding machine indicated generally by reference numeral 10. The carding machine, as is well known, may include a feed roller 12, a lickerin 14, a main cylinder or swift 16, and a doffer 18. A chain of carding flats 20 is mounted in the conventional manner above the main cylinder and is adapted to move relative to the main cylinder in such manner as to align the fibrous material carried on the cylinder. The feed roller delivers the fibrous material to the lickerin which, in turn, conveys the material to the main card cylinder. Doffer 18 removes the carded fibers from the main cylinder and delivers such material to calender means not shown. The arrangement of elements in the carding machine and the functioning thereof do not constitute a part of the present invention and, therefore, are not described in detail herein. However, a typical carding machine is shown in FIG. 1 since the preferred application of the dust collecting system of the present invention is in conjunction with such a carding machine.

The dust collecting system of this invention includes a dust collection tank 22 which is desirably an upright enclosure positionable upon the floor in the vicinity of the carding machine. The tank is provided in the interior thereof with a chamber 24 that is divided by a partition 26 to thereby subdivide the chamber into separate compartments 28 and 30 for the separate reception and collection of reusable fibrous material and waste material respectively. It will be understood, of course, that some minor portion of the material received and collected within compartment 28 may comprise waste material which is not suitable for recycling to the carding machine and that a minor proportion of the material received and collected in compartment 30 may comprise reusable fibrous material. However, the bulk of the material received in compartment 28 can be recovered for further use in the carding machine whereas the bulk of material received and collected in compartment 30 may be discarded.

Figure 5:
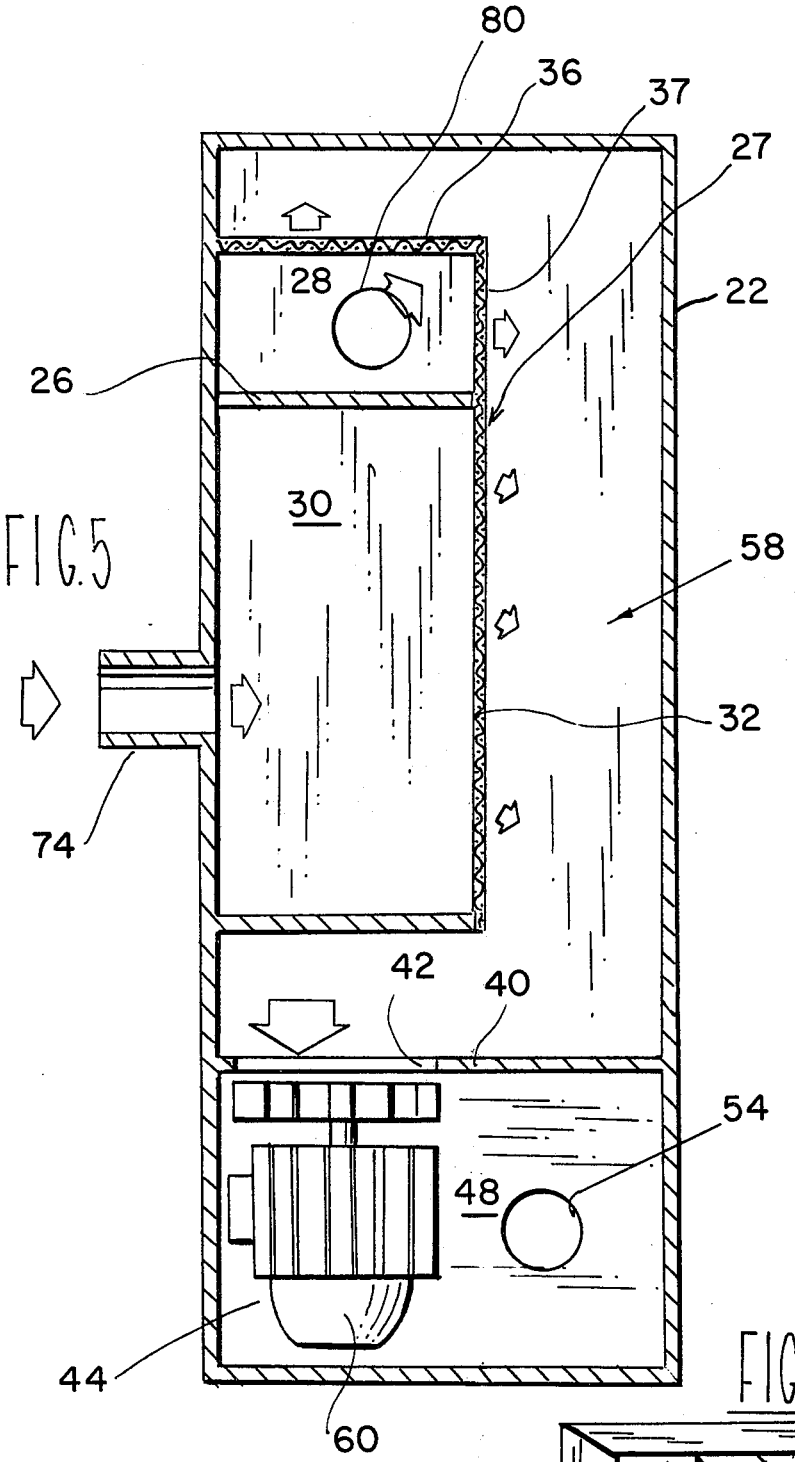
FIG. 5 is an end elevational view, in cross-section, of the tank element.

As shown most clearly in FIG. 5, wall 32 of compartment 30 as well as at least one of walls 34 and 36 of compartment 28 is desirably formed of a porous material which is capable of permitting the transmission of air therethrough but of preventing the passage of solid material such as the dust and fibers therethrough. Thus, walls 32, 34 and 36 function as filters. As shown in FIG. 1, a door 38 is pivotably mounted on the front end of the tank so that access may be provided to the interior of the tank, particularly to chamber 24 for the removal therefrom of waste material from compartment 30 and of fibrous material from compartment 28.

Referring further to FIGS. 1, 2 and 5, it will be seen that tank 22 is given a partition 40 which extends throughout the length of the tank. This partition is solid except for the provision of at least one opening 42, preferably circular in shape, and located above blower assemblies 44, 46 mounted within a blower assembly compartment 48 formed within the tank by partition 40. Openings 42 are formed in the horizontal partiton wall 40 closely adjacent the blower assemblies 44 and 46 for a purpose to be described below.

Referring to FIG. 1, it will be seen that a plurality of beams 50 are provided for the support of carding machine 10. When positioned beneath the carding machine such beams raise the machine to a height perferably in the range of from 10 to 20 centimeters from the floor. It has been found that the elevation of the machine from the floor level, and the provision of an unobstructed flow of a blanket of air from a location adjacent one end of the machine to the other is advantageous to the conveyance of waste material to a waste material receiving receptacle positioned adjacent one end of the machine. Such waste material receiving receptacle and the nozzle arrangement for providing the blanket of air adjacent to the floor thereby sweeping the area beneath the machine and forcing the waste material to the aforesaid waste material receiving receptacle will be hereinafter described. It will be noted that the carding machine 10 is mounted upon beams 50 to its elevated position.

An elongated air pressure stabilizing chamber 52 is located adjacent one end of the carding machine and is connected by conduit means 54 to tank 22. The connection of conduit 54 with tank 22 is desirably through an air junction box 56 which is secured to the back end of tank 22. In this manner the air pressure stabilizing chamber is connected with the blower assembly section 48 so as to provide for the recycling of filtered air which passes through filter walls 32, 34 and 36 into region 58 of the tank and through openings 42 in partition wall 40. A duct or conduit 82 is connected to junction box 56 for the partial discharge or venting of pressurized air from the system as may be desired.

At least one blower assembly, and preferably at least two such assemblies 44, 46 are mounted within section 48 and are powered by electric motors 60. Such blower assemblies are conventional induction fans which create sufficient suction forces to draw the filtered air from compartments 28 and 30 of chamber 24 and to convey the thus filtered air through conduit 54 to the chamber 52 from which it is discharged by means of ducts 62 and 64 into an air manifold 66 and thence out of a plurality of linearly spaced nozzles 68, 70 to form the blanket of air beneath the carding machine as indicated above. The blower assemblies are sufficiently powerful to induce a flow of waste materials suspended in air from the waste material receiving receptacle 72 via conduit 74 which connects the waste material receiving receptacle with chamber 24, particularly with compartment 30.

As stated above, a waste material receiving receptacle 72 is positioned adjacent the end of the carding machine opposite from the air pressure stabilizing chamber 52 and comprises a transversely extending box-like member in which an inlet 76 is provided for receiving the waste material suspended in the blanket of air formed by nozzles 68 and 70. The receptacle 72 is desirably formed with an upwardly sloping front wall 78, shown most clearly in FIG. 3, so as to serve as a deflector for any air and material suspended therein which may strike the receptacle above the level of its inlet and thereby adding to the efficiency of the waste material.

A conduit 80 is provided which terminates at one end thereof in compartment 28, the other end of conduit or duct 80 terminating adjacent the side of the carding machine so as to withdraw from that region of the carding machine, adjacent the flats, dust and fibrous material which may accumulate there. This material generally includes a substantially high proportion of reusable fibers than the waste material conveyed by conduit or duct 74 to compartment 30. It will thus be seen that by virtue of the segmented chamber 24 and the separate lines 74 and 80 provision is made for the separate reception and collection of waste material-containing air streams emanating from different regions of the carding machine. It will be appreciated, of course, that the end of conduit or duct 80 adjacent the carding machine may be connected to a hood or the like to facilitate withdrawal of the waste material from such region of the machine.

Figure 6:
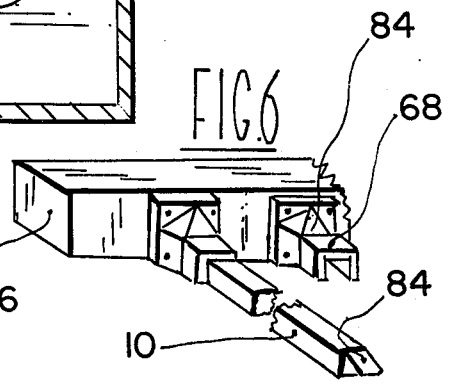
FIG. 6 is a perspective view of the air pressure stabilizing chamber employed in the system of the invention.

Referring to the FIGS. 1, 4 and 6 it will be observed that certain of the nozzles of the air manifold 66, particularly nozzles 70, extend a greater distance beneath the machine than other of the nozzles, i.e. further than nozzles 68. The nozzles are preferably staggered transversely of the machine, the total number of nozzles employed being selected in accordance with the width of the carding machine. Nozzles 68 preferably extend a sufficient distance from the air manifold to discharge air at a point beneath the doffer of the carding machine. Nozzles 70 extend further so as to discharge air therefrom approximately beneath the lickerin. This arrangement of nozzles, coupled with the provision of conduit or duct 80 in the area of the flats, provides for efficient and substantially complete removal of all waste material generated by the carding machine. It will also be observed that the arrangement of the nozzles and waste material receiving receptacle are such that the creation of the blanket of air beneath the machine, of approximately 150 to 200 millimeters of thickness, creates a unidirectional stream of waste material suspended in air from the nozzles to the receptacle. There are no obstructions in the path of this stream of air so that the combined effect of the air discharged from the nozzles and the suction force developed by the blower assemblies communicated to receptacle 72 via duct or conduit 74 produces enhanced waste removal results.

The nozzles 68 and 70 are desirably so constructed as to include a deflecting surface 84 at either of the locations shown in FIGS. 4 and 6 in order to assist in directing the stream of air discharged from the nozzles towards the floor and the inlet of receptacle 72.

A preferred aspect of the invention resides in so constructing beams 50 that at least a portion of the beam system or network can be employed as the duct or conduit for the conveyance of filtered air from tank 22 to air pressure stabilizing chamber 52. It will be appreciated that this obviates the need for a separate duct or conduit 54.

In the construction of the filter walls 32, 34 and 36 one or more of such walls may be formed from a filter material which is preferentially turned about itself so as to provide increased filtering surface.

Referring to FIG. 1 there is shown a deflector or screen 86 which may be conveniently mounted between opposed sections of beams 50. The screen may be secured to the beams in any conventional manner. However, it will be understood that the lower edge of the screen should not be so low as to interfere with the flow of air and material suspended therein from the nozzles into the inlet of receptacle 72. The principal object of providing the screen is to prevent the escape of air which may be laden with suspended dust and fibrous material from beneath the machine.

OPERATION OF THE DUST COLLECTING SYSTEM

Activation of the blower assemblies 44 induces a flow of filtered air from chamber 24 through openings 42 in partition wall 40 and develops a flow of pressurized air from tank 22 via duct or conduit 54 to the air stabilizing chamber 52 and into the air manifold 66. The pressurized air emanates from nozzles 68 and 70 beneath the carding machine to form a blanket of air adjacent the floor. This air stream picks up dust and fibrous material which has gravitated to the floor from the machine above and conveys it towards inlet 76 of the waste material receiving receptacle 72. The development of the air suction force by the blower assemblies is communicated to duct or conduit 74 connected between section 30 of chamber 24 and the receptacle 72. In this manner a suction force is developed at the inlet of the receptacle which cooperates with the air stream discharge from nozzles 68 and 70 to assist in the waste removal action taking place in the unobstructed area adjacent the floor beneath the carding machine. The suction force developed by the blower assemblies also is communicated via duct or conduit 80 to the region adjacent flats of the carding machine to withdraw dust and fibrous material from such region. It will thus be seen that an essentially closed recirculating system is provided which may easily be installed in connection with individual fiber processing machines. The pneumatic dust collecting system of this invention, through the unique combination of the nozzles and waste material receiving receptacle, as well as by virtue of the duct system between the tank 22, air distribution chamber 52 and receptacle 72 results in a waste removal system which can be operated at extremely lowpower consumption levels, e.g. of the order of 1 horsepower.

Unlike many prior art waste removal systems the flow of air which sweeps beneath the machine is unidirectional and is oriented so as to directly enter the waste material receiving receptacle without having to travel a tortuous path which tends to adversely effect the suction developed within the system and necessitates higher power consumption.

I claim:

1. A pneumatic dust collecting system for a fiber processing machine comprising a plurality of beams adapted to rest on a floor and support a fiber processing machine above the floor, a tank for the collection of dust and fibrous material, a chamber within said tank adapted to receive and collect separate streams of said dust and fibrous material, at least one wall of said chamber being adapted to function as a filter for said dust and fibrous material, an air expansion compartment within said tank adjacent said receiving and collecting chamber, at least said filter wall of said chamber being common to said chamber and compartment, a blower assembly positioned within said tank adapted to apply suction to said compartment and to draw air therefrom, an air pressure stabilizing chamber, means for connecting said stabilizing chamber with said tank so as to convey a stream of pressurized air thereto from said tank, an air manifold having a plurality of linearly spaced discharge nozzles connected to said stabilizing chamber and positioned beneath one end of said machine, said nozzles being adapted to discharge a blanket of air beneath said fiber processing machine from a first location adjacent said one end of said machine to a second location adjacent the opposite end of said machine, a waste material receiving receptacle being positioned at said second location, said discharge nozzles and receptacle extending transversely of said machine and said receptacle including a transversely extending inlet, said receptacle being in communication with said receiving and collecting chamber for supplying a stream of air and dust thereto, conduit means being provided for connecting said receiving and collecting chamber with at least one location of said machine where waste fibrous material tends to accumulate, and means for effecting operation of said blower assembly, whereby waste material on the floor beneath said machine is acted upon by air streams discharged from said nozzles and suction forces emanating from the inlet of said receptacle and thereby is advanced in a unidirectional manner to said receptacle for conveyance to said receiving and collecting chamber.

2. A pneumatic dust collecting system according to claim 1, wherein selected ones of said beams are hollow and comprise the connecting means between said air stabilizing chamber and said tank.

3. A pneumatic dust collecting system according to claim 1, including a horizontal partition wall within said tank below said air expansion compartment to thus form a blower assembly section, said blower assembly being mounted within said blower assembly section, said connecting means between said air stabilizing chamber and tank extending between said air stabilizing chamber and said blower assembly section, and said horizontal partition wall having at least one opening therein above the blower assembly for applying suction to said expansion chamber.

4. A pneumatic dust collecting system according to claim 1, wherein said support beams are dimensioned to support said machine a distance of from 15 to 20 cm. above the floor.

5. A pneumatic dust collecting system according to claim 1, wherein said machine is a fiber carding machine including a lickerin, main card cylinder and doffer, said conduit means for connecting said receiving and collecting chamber with said at least one location of the machine where fibers tend to accumulate being adapted to convey waste material from at least one of said main card cylinder and doffer.

6. A pneumatic dust collecting system according to claim 1, wherein said receiving and collecting chamber within said tank is partitioned into first and second sections, said waste material receiving receptacle being connected by conduit means with said first section and said one location of said machine at which fibrous material tends to accumulate being connected to said second section.

7. A pneumatic dust collecting system according to claim 6, wherein said nozzles are adapted to direct the streams of air discharged therefrom towards the floor, said waste material receiving means having a portion of the front wall thereof facing said nozzles inclined upwardly in the forward direction so as to deflect air from said nozzles towards the inlet of the receptacle.

8. A pneumatic dust collecting system according to claim 7, wherein selected ones of said nozzles extend from said air manifold a greater distance towards said waste material receiving receptacle than the remainder of said nozzles.

* * * * *